US005740562A

United States Patent [19]

Nickalo

[11] Patent Number: 5,740,562

[45] Date of Patent: Apr. 21, 1998

[54] POOL PROTECTOR DEVICE

[76] Inventor: Cathy J. Nickalo, 6904 Glen Ridge Cir., Apt. B1, Glen Burnie, Md. 21061

[21] Appl. No.: 652,268

[22] Filed: May 23, 1996

[51] Int. Cl.[6] ..... E04H 4/00

[52] U.S. Cl. ..... 4/504; 4/496; 4/498; 4/503

[58] Field of Search ..... 4/504, 496, 498, 4/503

[56] References Cited

U.S. PATENT DOCUMENTS 3,495,279 2/1970 Regan et al. ..... 4/498
3,872,522 3/1975 Bennett et al. .
5,067,182 11/1991 Koelsch .
5,216,762 6/1993 Denny .
5,303,527 4/1994 Perez et al. .

*Primary Examiner*—David J. Walczak
*Attorney, Agent, or Firm*—Michael I. Kroll

[57] ABSTRACT

A pool protector device (10) which comprises a plurality of panels (12). A facility (14) is for interlocking the panels (12) together in side by side relationships to form a larger covering which will extend across a swimming pool (16) and be elevated above water (18) therein. Components (20) are for securing edges of the outermost panels (12) onto sidewalls (22) of the swimming pool (16), so as to prevent access to the water (18) in the swimming pool (16), eliminating accidental drowning when the swimming pool (16) is left unattended.

16 Claims, 3 Drawing Sheets

POOL PROTECTOR DEVICE

BACKGROUND OF THE INVENTION

1. Field of the Invention

The instant invention relates generally to pool covers and more specifically it relates to a pool protector device.

2. Description of the Prior Art

Numerous pool covers have been provided in prior art. For example, U.S. Pat. Nos. 3,872,522 to Bennett et al.; 5,067,182 to Koelsch; 5,216,762 to Denny and 5,303,527 to Perez et al. all are illustrative of such prior art. While these units may be suitable for the particular purpose to which they address, they would not be as suitable for the purposes of the present invention as heretofore described.

BENNETT, ROBERT BR.

BENNETT, CHARLOTTE S.

PROTECTIVE COVER FOR POOLS

U.S. Pat. No. 3,872,522

A protective cover for pools of liquid such as swimming pools consisting of a plurality of separate panels each of a size and material such that the panel will have a predetermined buoyancy factor. At least one face of each panel having a series of indentations formed therein with at least some portion of the indentations being provided with bores opening on the opposite face of the panel. At least a portion of the indentations adjacent the edges of the panels are of a sufficient size to provide hand holds for individuals; while these and the remaining indentations serve as receptacles for receiving debris deposited on the surface of the panel, or when in contact with the water serve to reduce water absorption and wind displacement.

KOELSCH, LESTER M.

SWIMMING POOL COVER

U.S. Pat. No. 5,067,182

A modular floating swimming pool cover includes a series of buoyant panels which are hinged together to form a row of panels. The cover can include several adjacent rows. The hinge includes spaced hinge links which fit into slots in the panel ends allowing alternate direction or accordion folding for vertical stack storage and ease in swinging into a use position floating on the liquid surface of the pool.

DENNY, THOMAS P.

FLOATING POOL COVER APPARATUS

U.S. Pat. No. 5,216,762

A floating pool cover arranged for flotation about the top surface of a swimming pool to provide for passive heating during periods of depressed temperatures and reflection of heat during periods of elevated temperatures is provided as a housing formed with an opaque darkened bottom floor and a convex transparent top, with ends defining a top wall of the housing wherein spaced first and second buoyant chambers are formed co-extensively at opposed end walls of the organization. The invention is further arranged to include interlocking pegs received within accommodating apertures between adjacent panels to provide for a matrix of the housings for flotation and accommodation of variously configured pools. Further, the organization may be optionally provided with a releasing chamber to direct chemical into the underlying pool during periods of elevated temperature conditions.

PEREZ, IGNACIO

PEREZ, ALAIN M.

REMOVABLE POOL COVER SUPPORT APPARATUS

U.S. Pat. No. 5,303,527

A removable support apparatus for supporting a swimming pool cover employs adjustable frame assemblies capable of spanning between opposite edges at opposite sides of the pool. Each frame assembly includes a pair of separate frame members placed in side-by-side relation to one another, so that together they define the overall length of the frame assembly. The frame members are displacable longitudinally relative to one another to adjust the overall length of the frame assembly to match the distance between the opposite edges of the pool, so that the frame assembly can fit across the pool between its opposite edges. Each frame assembly also includes an end support member attached to the outer end of each frame member and supporting the frame member from one of the opposite edges of the pool. The frame assembly further includes adjustable attaching members releasably attaching the frame members to one another in the longitudinally-displaced side-by-side relation such that the frame assembly will span between the opposite sides of the pool. The removable support apparatus also includes at least one adjustable column support member removably installed in upright standing relation on the bottom of the pool and releasably supporting a selected frame assembly, and a frame work overlying and supported by the frame assemblies to span across the length and width of the swimming pool for, in turn, supporting a pool cover.

SUMMARY OF THE INVENTION

A primary object of the present invention is to provide a pool protector device that will overcome the shortcomings of the prior art devices.

Another object is to provide a pool protector device which when properly secured to a swimming pool would prevent access to water within the swimming pool, thereby eliminating accidental drowning when the swimming pool is left unattended.

An additional object is to provide a pool protector device consisting of strong lightweight plastic six foot by six foot interlocking panels, which are weatherproof, long-lasting and convenient to be handled by an average sized person.

A further object is to provide a pool protector device that is simple and easy to use.

A still further object is to provide a pool protector device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 5:
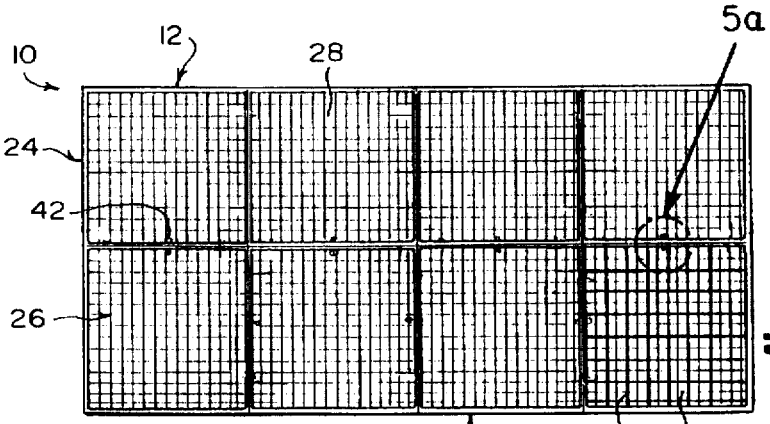
FIG. 5 is a top plan view taken in the direction of arrow 5 in FIG. 1 removed from the pool, with the lower left panel being the first modification.
Figure 5A:
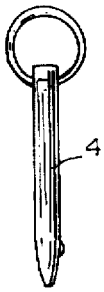

FIG. 5*a* is an enlarged view of the lock pin as indicated by arrow 5*a* in FIG. 5.

Figure 5B:
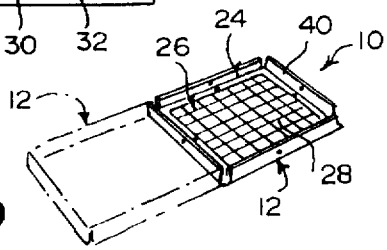

FIG. 5*b*is a bottom perspective view of a second modification being a panel having four identical flanged sides and showing in phantom, a top perspective view of another panel interconnected thereto.

Figure 6:
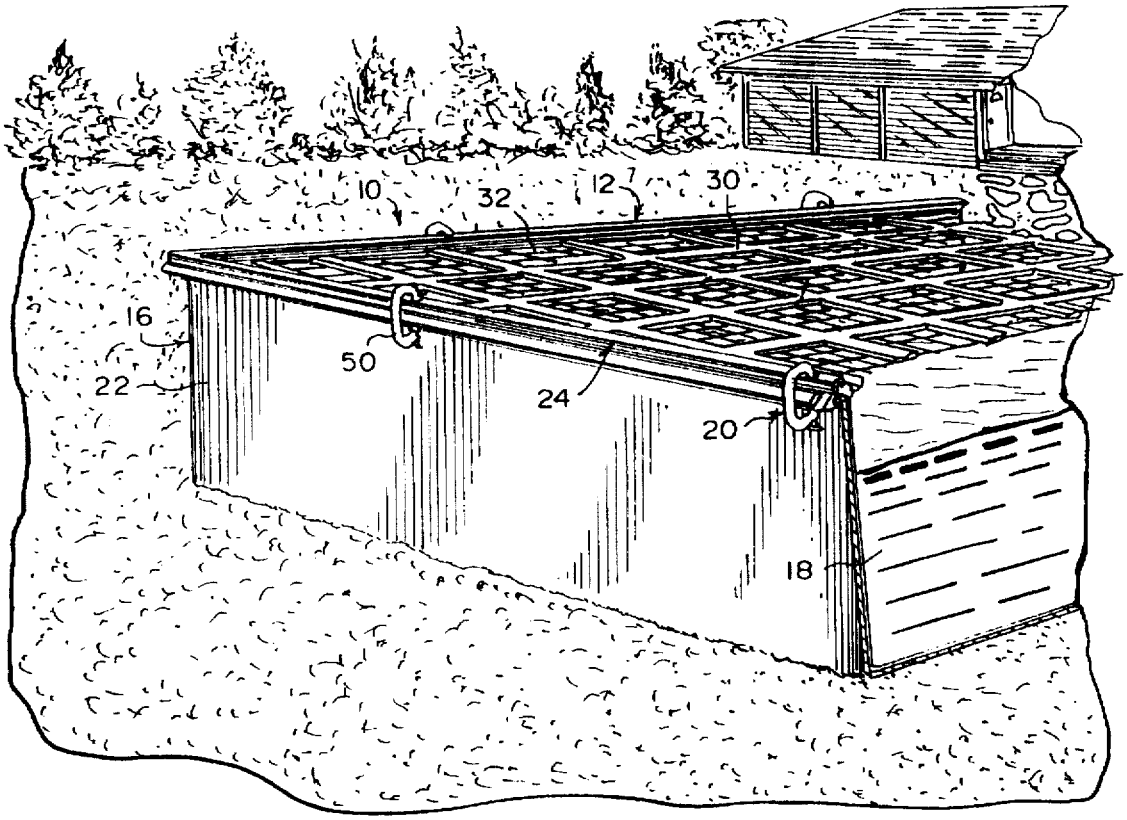

FIG. 6 is a perspective view with parts broken away and in section of an above ground swimming pool with a third modification of the instant invention attached thereto.

Figure 7:
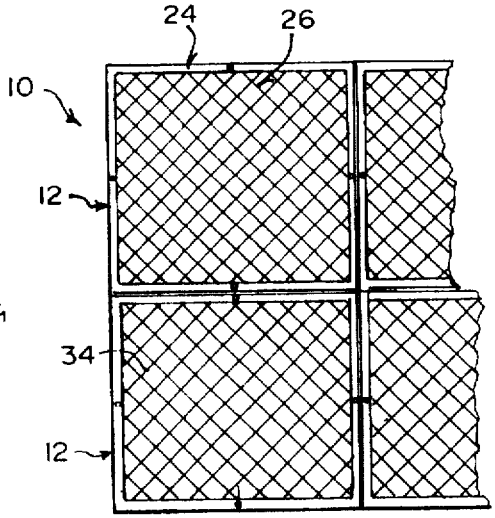

FIG. 7 is a top plan view with parts broken away of a fourth modification of the instant invention.

Figure 8:
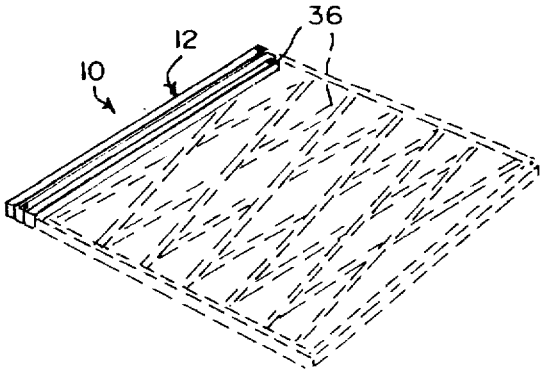

FIG. 8 is a perspective view of a fifth modification being a scissor action expandable gate panel shown in a closed position and in an extended position in dotted lines.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 8 illustrate a pool protector device 10, which comprises a plurality of panels 12. A facility 14 is for interlocking the panels 12 together in side by side relationships to form a larger covering which will extend across a swimming pool 16 and be elevated above water 18 therein. Components 20 are for securing edges of the outermost panels 12 onto sidewalls 22 of the swimming pool 16, so as to prevent access to the water 18 in the swimming pool 16, eliminating accidental drowning when the swimming pool 16 is left unattended.

Each panel 12 includes a four sided frame 24 having parallel sides. A screen 26 is within the frame 24 that is small enough to prevent a small child and pet from falling through.

The screen 26 is a grid style pattern 28, as shown in FIGS. 1, 2, 4, 5 and 5*b*. The screen 26 is a large grid style pattern 30 with a small grid style pattern 32 interposed between the large grid style pattern 30, as shown in FIGS. 3 and lower right corner in FIG. 5.

The screen 26, as shown in FIG. 7, is a lattice style pattern 34. Each panel 12, as shown in FIG. 8, is a scissor action expandable gate 36. Each panel 12 is square shaped and fabricated out of a sturdy lightweight waterproof material 38.

The interlocking facility 14 consists of a hook flange 40 integral with each side of the panel 12, so that two hook flanges 40 will engage with each other to maintain two panels 12 together. A plurality of lock pins 42 are provided. Each lock pin 42 can be inserted horizontally through two hook flanges 40 on the sides of two panels 12 that are engaged with each other to keep the panels 12 together.

Figure 1:
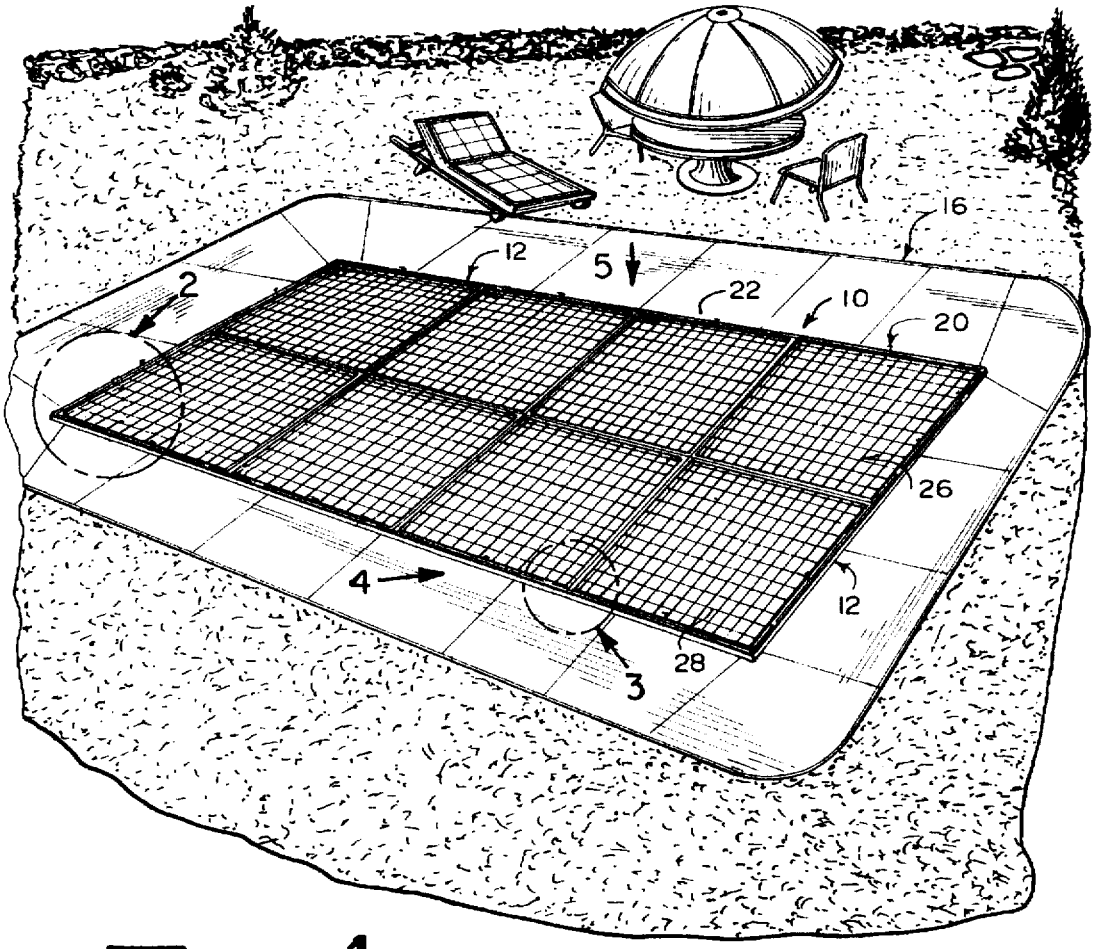
FIG. 1 is a perspective view showing the instant invention installed over an in-ground swimming pool.
Figure 2:
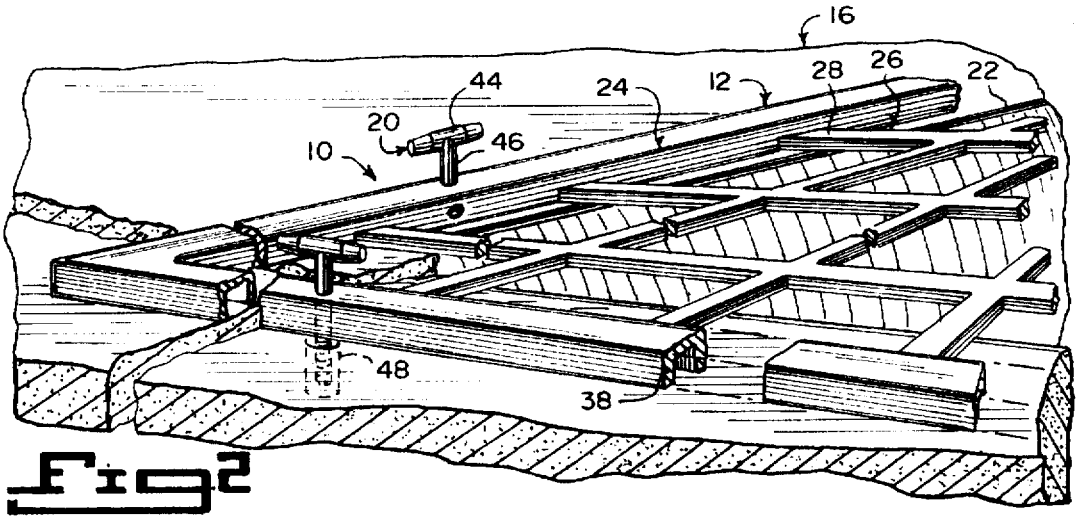
FIG. 2 is an enlarged perspective view of the area indicated by arrow 2 in FIG. 1, with parts broken away and in section.
Figure 3:
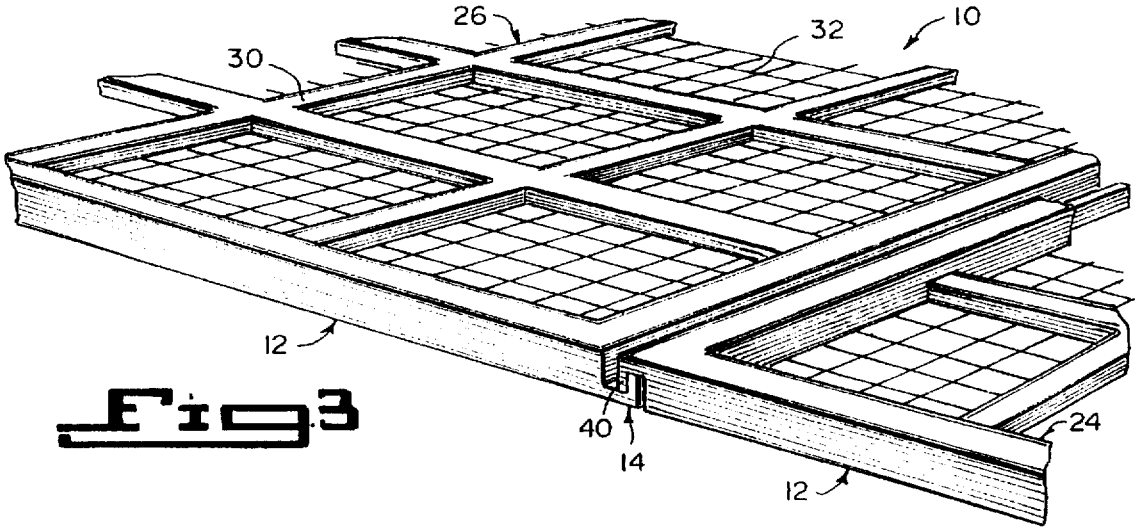
FIG. 3 is an enlarged perspective view of the area indicated by arrow 3 in FIG. 1, being a first modification thereof removed from the pool.
Figure 4:
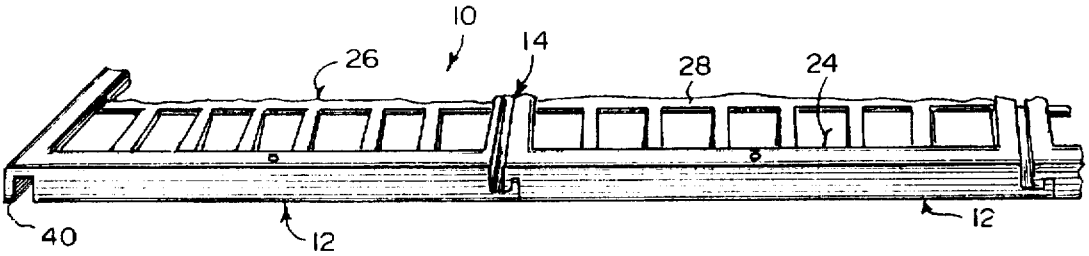
FIG. 4 is an enlarged perspective view taken in the direction of arrow 4 in FIG. 1, with parts broken away removed from the pool.

As best seen in FIG. 2, the components 20 are a plurality of T-handle connectors 44. Each T-handle connector 44 having a threaded shaft 46 can extend vertically through an edge of the outermost panel 12 and into a threaded socket 48 in the sidewall 22 of the swimming pool 16 that is built in-ground. The securing components 20, shown in FIG. 6, are a plurality of C-clamps 50. Each C-clamp 50 can clamp onto an edge of the outermost panel 12 and the sidewall 22 of the swimming pool 16 that is built above ground.

OPERATION OF THE INVENTION

To use the pool protector device 10, the following steps should be taken:

1. Assemble the panels 12 together with the hook flanges 40 engaging with each other to maintain the panels 12 together.
2. Insert each of the lock pins 42 horizontally through two engaged hook flanges of the panels 12 to keep the panels 12 together.
3. Place the assembled panels 12 over the swimming pool 12, so that the panels 12 will extend across the swimming pool 16 and be elevated above the water 18.
4. Put each threaded shaft 46 of the T-handle connectors through an edge of an outermost panel 12, so it can thread into a threaded socket 48 in a sidewall 22 of the swimming pool 16 that is build in-ground.
5. Clamp each C-clamp 50 onto an edge of an outermost panel 12 and the sidewall 22 of the swimming pool 16 that is built above ground.

LIST OF REFERENCE NUMBERS

10 pool protector device
12 panel of 10
14 interlocking facility of 10
16 swimming pool
18 water in 16
20 securing component of 10
22 sidewall of 16
24 four sided frame of 12
26 screen of 12
28 grid style pattern for 26
30 large grid style pattern of 26
32 small grid style pattern in 30
34 lattice style pattern for 26
36 scissor action expandable gate for 12
38 sturdy lightweight waterproof material of 12
40 hook flange of 14
42 lock pin
44 T-handle connector for 20
46 threaded shaft of 44
48 threaded socket in 22
50 C-clamp for 20

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A pool protector device which comprises:

a) a plurality of panels;

b) means for interlocking said panels together in side by side relationships to form a larger covering, including outermost panels, which will extend across a swimming pool and be elevated above water therein, said interlocking means including:

i) a hook flange integral with each side of said panel, so that two said hook flanges will engage with each other to maintain two said panels together; and ii) a plurality of lock pins, in which each said lock pin can be inserted horizontally through said two hook flanges on the sides of two said panels that are engaged with each other to keep said panels together; and c) means for securing edges of said outermost panels onto sidewalls of the swimming pool, so as to prevent access to the water in the swimming pool, eliminating accidental drowning when the swimming pool is left unattended.

2. A pool protector device as recited in claim 1, wherein each said panel includes:

a) a four sided frame having parallel sides; and b) a screen within said frame that is small enough to prevent a small child and pet from falling through.

3. A pool protector device as recited in claim 2, wherein said screen is a grid style pattern.

4. A pool protector device as recited in claim 2, wherein said screen is a large grid style pattern with a small grid style pattern interposed between said large grid style pattern.

5. A pool protector device as recited in claim 2, wherein said screen is a lattice style pattern.

6. A pool protector device which comprises:

a) a plurality of panels, each of which is a scissor action expandable gate;

b) means for interlocking said panels together in side by side relationships to form a larger covering which will extend across a swimming pool and be elevated above water therein; and c) means for securing outermost edges of said panels onto sidewalls of the swimming pool, so as to prevent access to the water in the swimming pool, eliminating accidental drowning when the swimming pool is left unattended.

7. A pool protector device as recited in claim 1, wherein said securing means includes a plurality of T-handle connectors, in which each said T-handle connector having a threaded shaft can extend vertically through an edge of said outermost panel and into a threaded socket in the sidewall of a swimming pool that is built in-ground.

8. A pool protector device as recited in claim 1, wherein said securing means includes a plurality of C-clamps, in which each said C-clamp can clamp onto an edge of said outermost panel and the sidewall of a swimming pool that is built above ground.

9. A pool protector device which comprises:

a) a plurality of panels, wherein each said panel is square shaped and fabricated out of a sturdy lightweight waterproof material;

b) means for interlocking said panels together in side by side relationships to form a larger covering, including outermost panels, which will extend across a swimming pool and be elevated above water therein, said interlocking means including:

i) a hook flange integral with each side of said panel, so that two said hook flanges will engage with each other to maintain two said panels together; and ii) a plurality of lock pins, in which each said lock pin can be inserted horizontally through said two hook flanges on the sides of two said panels that are engaged with each other to keep said panels together; and c) means for securing edges of said outermost panels onto sidewalls of the swimming pool, so as to prevent access to the water in the swimming pool, eliminating accidental drowning when the swimming pool is left unattended.

10. A pool protector device as recited in claim 9, wherein each said panel includes:

a) a frame; and b) a screen within said frame that is small enough to prevent a small child and pet from falling through.

11. A pool protector device as recited in claim 10, wherein said screen is a grid style pattern.

12. A pool protector device as recited in claim 10, wherein said screen is a large grid style pattern with a small grid style pattern interposed between said large grid style pattern.

13. A pool protector device as recited in claim 10, wherein said screen is a lattice style pattern.

14. A pool protector device as recited in claim 9, wherein each said panel is a scissor action expandable gate.

15. A pool protector device as recited in claim 9, wherein said securing means includes a plurality of T-handle connectors, in which each said T-handle connector having a threaded shaft can extend vertically through an edge of said outermost panel and into a threaded socket in the sidewall of a swimming pool that is built in-ground.

16. A pool protector device as recited in claim 9, wherein said securing means includes a plurality of C-clamps, in which each said C-clamp can clamp onto an edge of said outermost panel and the sidewall of a swimming pool that is built above ground.

* * * * *